US008070159B2

(12) United States Patent
Honda et al.

(10) Patent No.: US 8,070,159 B2
(45) Date of Patent: Dec. 6, 2011

(54) SWITCHBACK MECHANISM AND IMAGE FORMING APPARATUS

(75) Inventors: Haruyuki Honda, Ibaraki-Pref (JP); Hiroshi Fujiwara, Osaka (JP); Yasuhide Ohkubo, Osaka (JP); Ippei Kimura, Osaka (JP); Toshikane Nishii, Osaka (JP); Shigeo Nanno, Kyoto (JP); Mizuna Tanaka, Osaka (JP); Tomoyoshi Yamazaki, Ibaraki-Pref (JP); Masafumi Takahira, Ibaraki-Pref (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 12/929,651

(22) Filed: Feb. 7, 2011

(65) Prior Publication Data

US 2011/0127707 A1 Jun. 2, 2011

Related U.S. Application Data

(62) Division of application No. 12/149,331, filed on Apr. 30, 2008, now Pat. No. 7,918,451.

(30) Foreign Application Priority Data

May 17, 2007 (JP) ..... 2007-131767

(51) Int. Cl.
*B65H 39/10* (2006.01)

(52) U.S. Cl. ..... 271/301; 271/225; 271/303; 271/186

(58) Field of Classification Search ..... 271/225, 271/186, 301, 302, 303, 304, 184, 185
See application file for complete search history.

(56) References Cited

U.S. PATENT DOCUMENTS

| | | | | |
|---|---|---|---|---|
| 4,699,365 | A | 10/1987 | Smith et al. | |
| 5,196,897 | A * | 3/1993 | Trask | 399/364 |
| 5,201,518 | A * | 4/1993 | Isoda | 271/305 |
| 5,449,164 | A | 9/1995 | Quesnel et al. | |
| 5,709,376 | A | 1/1998 | Ushirogata | |
| 6,769,682 | B2 | 8/2004 | Sumi et al. | |
| 7,431,293 | B2 | 10/2008 | Carter et al. | |
| 7,717,423 | B2 * | 5/2010 | Litman et al. | 271/273 |

(Continued)

FOREIGN PATENT DOCUMENTS

JP 10-198182 7/1998

(Continued)

OTHER PUBLICATIONS

English language Abstract of Japanese Patent Publication JP 2003-182907 dated Jul. 3, 2003.

*Primary Examiner* — Stefanos Karmis
*Assistant Examiner* — Howard Sanders
(74) *Attorney, Agent, or Firm* — Harness, Dickey & Pierce, P.L.C.

(57) ABSTRACT

In a color printer in which a drive force of a fixed gear that rotates not in both a forward direction and a reverse direction but in either one direction only is transmitted to a discharging unit, a swing gear is attached to a branch guide via a switching link and a transmission link as a link mechanism. When a solenoid mechanism starts driving, the transmission link rotates. In accordance with the rotation of the transmission link, the switching link rotates, so that a switching among a discharge conveying path, a duplex-printing conveying path, and a switchback conveying path by the branch guide and a switching of a rotating direction of a transmission gear can be simultaneously performed.

17 Claims, 4 Drawing Sheets

U.S. PATENT DOCUMENTS

| | | | | |
|---|---|---|---|---|
| 7,762,552 | B2 * | 7/2010 | Guerand et al. | 271/303 |
| 7,764,920 | B2 * | 7/2010 | Lin et al. | 399/374 |
| 7,946,578 | B2 * | 5/2011 | Hatayama et al. | 271/186 |
| 2002/0163121 | A1 | 11/2002 | Sette et al. | |
| 2005/0189712 | A1 | 9/2005 | Carter et al. | |
| 2007/0065201 | A1 * | 3/2007 | Fujiwara et al. | 399/405 |
| 2007/0273085 | A1 | 11/2007 | Nanno et al. | |
| 2008/0006166 | A1 | 1/2008 | Ohkubo et al. | |
| 2008/0054554 | A1 | 3/2008 | Nishii et al. | |
| 2008/0273908 | A1 * | 11/2008 | Ohkubo et al. | 399/405 |
| 2009/0110459 | A1 | 4/2009 | Honda et al. | |

FOREIGN PATENT DOCUMENTS

| | | |
|---|---|---|
| JP | 2000-344412 | 12/2000 |
| JP | 2001-063892 | 3/2001 |
| JP | 2001-312159 | 11/2001 |
| JP | 2005-194089 | 7/2005 |
| JP | 2007-076881 | 3/2007 |
| JP | 3996387 | 8/2007 |

* cited by examiner

SWITCHBACK MECHANISM AND IMAGE FORMING APPARATUS

CROSS-REFERENCE TO RELATED APPLICATIONS

This application claims priority under 35 USC §121 to and is a Divisional of U.S. application Ser. No. 12/149,331 filed Apr. 30, 2008 now U.S. Pat. No. 7,918,451, which claims priority from Japanese priority document 2007-131767 filed in Japan on May 17, 2007, the entire contents of each of which are hereby incorporated herein by reference.

BACKGROUND

1. Field of the Invention

Example embodiments relate to a switchback mechanism that performs switchback of a sheet and an image forming apparatus including the switchback mechanism.

2. Description of the Related Art

A typical image forming apparatus capable of duplex printing includes a discharging unit that discharges a sheet and a switchback unit that performs switchback of a sheet for duplex printing. The discharging unit and the switchback unit can be realized with two conveying rollers or three conveying rollers. When the discharging unit and the switchback unit are realized with two conveying rollers, switchback of a sheet for duplex printing is performed after the sheet has been discharged.

On the other hand, when the discharging unit and the switchback unit are realized with three conveying rollers discharging of a sheet and switchback of the sheet can be performed simultaneously. Specifically, when the discharging unit and the switchback unit is realized with first to third discharge rollers, discharging of a sheet is performed by the first and second discharge rollers and switchback of the sheet is performed by the second and third discharge rollers. Therefore, the work efficiency can be improved as compared with those composed of two conveying rollers. Incidentally, the first to third discharge rollers are arranged in such a manner that the second discharge roller is located between the first and third discharge rollers and the first and the third discharge rollers make a contact with the second discharge roller. When an image is to be formed on only one side of a sheet, after the image is formed on the side of the sheet, the sheet is discharged onto a sheet receiving tray by passing through the first and second discharge rollers. When an image is to be formed on both sides of a sheet, after the image is formed on one side of the sheet, the sheet is conveyed toward the sheet receiving tray by passing through the second and third discharge rollers. After that, the sheet is switchback-conveyed by a reverse rotation of the second discharge roller, and conveyed to a duplex-printing path by passing through the second and third discharge rollers. After the image is formed on the other side of the sheet, the sheet is discharged onto the sheet receiving tray by passing through the first and second discharge rollers.

To exercise such a duplex-printing function, a conventional image forming apparatus must be provided with a drive source capable of driving discharge rollers to rotate in any of a forward direction and a reverse direction and a branch guide for switching a conveying path of a sheet to a switchback conveying path when an image is to be formed on both sides of the sheet.

There has been developed an image forming apparatus that can simultaneously perform switching of a conveying path and switching of a rotating direction of a gear by the use of a drive force of the gear that is driven to rotate in one direction only, i.e., not in both the forward direction and the reverse direction but in either one direction (see, for example, Japanese Patent Application Laid-open No. 2007-76881). Specifically, such an image forming apparatus includes a plurality of conveying paths, three conveying rollers, a switching guide, a drive unit, and a plurality of gears. The conveying rollers respectively rotate by having contact with the adjacent conveying roller. The switching guide guides a sheet to any one of the conveying paths when an image is to be formed on both sides of the sheet. The drive unit drives the conveying rollers to rotate. The gears transmit a drive force from the drive unit to the conveying rollers. With such a configuration, there is no need to provide a drive source capable of driving the conveying rollers to rotate in both the forward direction and the reverse direction. Therefore, the configuration of the image forming apparatus can be simplified as compared with that of the conventional image forming apparatus.

However, there is still room for improvement in the configuration of the image forming apparatus.

SUMMARY

It is an object of the example embodiments to at least partially solve the problems in the conventional technology.

According to an aspect of example embodiments of the present invention, there is provided a switchback mechanism including a first roller group composed of a first roller, a second roller, and a third roller, the second roller being in contact with the first roller and the third roller; a second roller group composed of a fourth roller and a fifth roller, the fourth roller and the fifth roller being in contact with each other; a switching guide that rotates around a rotating shaft supported by a supporting member, and switches a conveying path of a sheet between a switchback conveying path and a non-switchback conveying path, the switchback conveying path connecting between a first nip portion formed between the fourth roller and the fifth roller and a second nip portion formed between the second roller and the third roller, and the non-switchback conveying path connecting between the second nip portion and a third nip portion formed between the first roller and the second roller via the first nip portion; a drive gear that is coupled to the fourth roller, and rotates in a first direction by receiving a drive force from the fourth roller; a first transmission-gear group that is composed of even numbers of transmission gears, and transmits a drive force from the drive gear as a rotation in the first direction; a second transmission-gear group that is composed of odd numbers of transmission gears, and transmits the drive force from the drive gear as a rotation in a second direction opposite to the first direction; a switching gear that is connected to any of the first transmission-gear group and the second transmission-gear group, and transmits the drive force from the drive gear to the second roller as any of the rotation in the first direction and the rotation in the second direction via a third transmission-gear group composed of even numbers of transmission gears; a first link that the switching gear is attached to one end thereof, and rotates around the rotating shaft to switch a connection of the switching gear to any of the first transmission-gear group and the second transmission-gear group; and a second link that is connected to the other end of the first link to interlock the connection of the switching gear to any of the first transmission-gear group and the second transmission-gear group with a conveyance of the sheet to any of the switchback conveying path and the non-switchback conveying path switched by the switching guide.

According to another aspect of example embodiments of the present invention, there is provided an image forming apparatus including an image forming unit that forms an image on a sheet; a fixing unit that fixes the image formed on the sheet by the image forming unit; and a discharging unit that discharges the sheet, when an image is to be formed on both sides of the sheet, in such a manner that after the image is formed on one side of the sheet by the image forming unit and fixed thereon by the fixing unit, the discharging unit conveys the sheet to a switchback conveying path, and then switchback-conveys the sheet toward the image forming unit and the fixing unit through a first conveying path, and after the image is formed on other side of the sheet by the image forming unit and fixed thereon by the fixing unit, the discharging unit conveys the sheet through a second conveying path to discharge the sheet from the image forming apparatus. The discharging unit includes the above switchback mechanism.

The above and other objects, features, advantages and technical and industrial significance of this invention will be better understood by reading the following detailed description of presently preferred embodiments of the invention, when considered in connection with the accompanying drawings.

DETAILED DESCRIPTION OF EXAMPLE EMBODIMENTS

Exemplary embodiments of the present invention are explained in detail below with reference to the accompanying drawings. The present invention is not limited to the embodiments.

Figure 1:
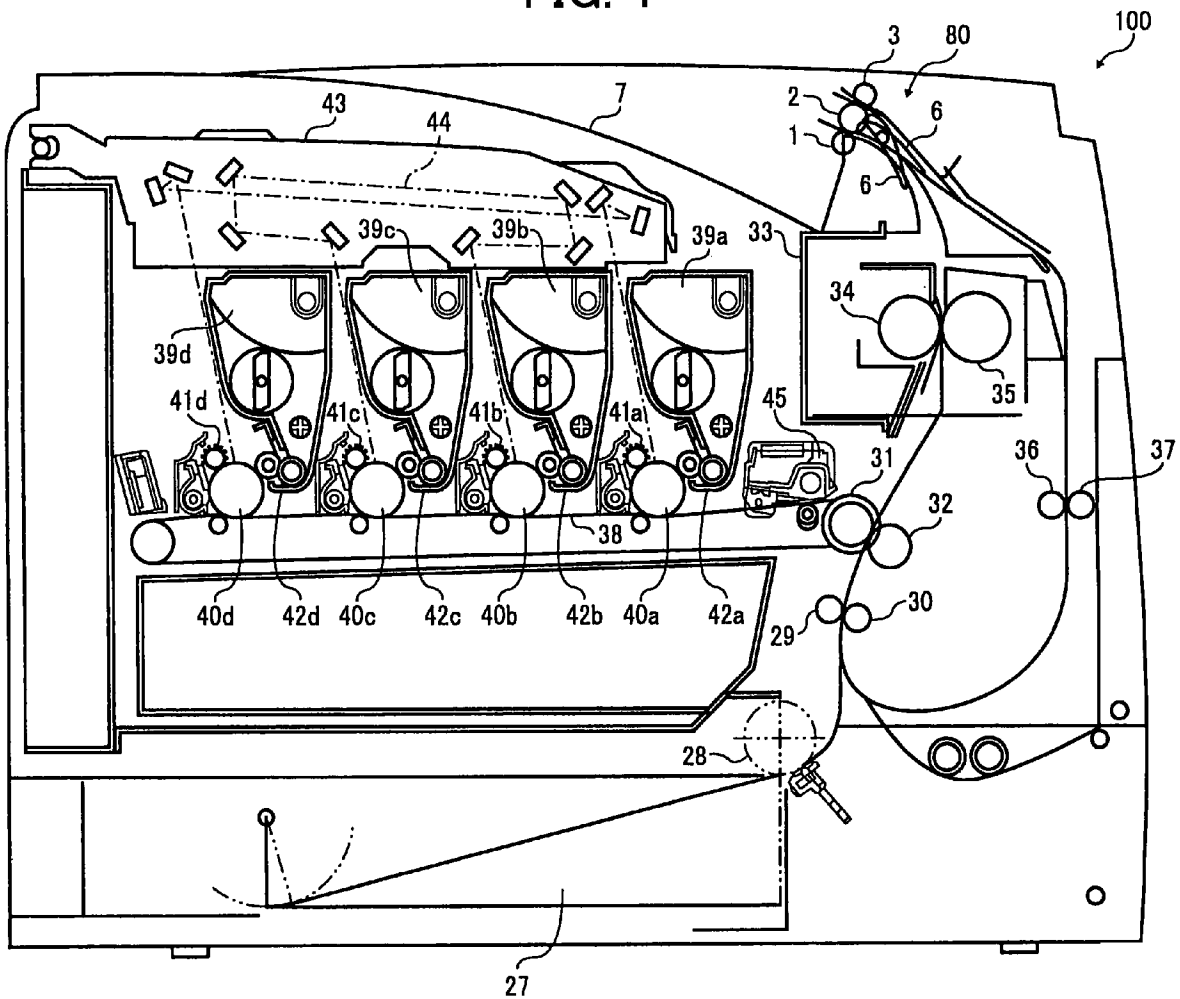
FIG. 1 is a schematic diagram of a color printer according to an embodiment of the present invention.

FIG. 1 is a schematic diagram of a color printer 100 according to an embodiment of the present invention. In the embodiment, a 4-drum tandem electrophotographic color printer is used as the color printer 100; however, the present invention is not limited thereto. The present invention can be applied to a conveyance switching mechanism included in any other types of image forming apparatuses, such as a monochrome printer, a facsimile machine, and a digital multifunction product (MFP).

The color printer 100 includes four process units 42*a* to 42*d*, an exposure unit 43, an intermediate-transfer-belt cleaning unit 45, an intermediate transfer belt 38, a transfer drive roller 31, a transfer driven roller 32, a feed roller 28, a fixing unit 33, a discharging unit 80, a sheet cassette 27, a pair of registration rollers 29 and 30, a pair of conveying rollers 36 and 37, and a sheet receiving tray 7.

The process units 42*a* to 42*d* form yellow (Y), magenta (M), cyan (C), and black (K) toner images, respectively. The process unit 42*a* includes a developing unit 39*a*, a photosensitive drum 40*a*, and a charging roller 41*a*. The process unit 42*b* includes a developing unit 39*b*, a photosensitive drum 40*b*, and a charging roller 41*b*. The process unit 42*c* includes a developing unit 39*c*, a photosensitive drum 40*c*, and a charging roller 41*c*. The process unit 42*d* includes a developing unit 39*d*, a photosensitive drum 40*d*, and a charging roller 41*d*. The developing units 39*a* to 39*d* contain therein Y, M, C, and K toners, respectively, as a developer. The charging rollers 41*a* to 41*d* have contact with the photosensitive drums 40*a* to 40*d*, respectively.

An electrostatic latent image and a toner image are formed on a surface of each of the photosensitive drums 40*a* to 40*d*.

The exposure unit 43 is a typical optical writing device, such as a laser writing device. The exposure unit 43 exposes each of the charged photosensitive drums 40*a* to 40*d* to a laser light 44 corresponding to image data, and thereby forming an electrostatic latent image on the surface of each of the photosensitive drums 40*a* to 40*d*.

The charging rollers 41*a* to 41*d* charge the photosensitive drums 40*a* to 40*d*, respectively.

The developing units 39*a* to 39*d* respectively develop the electrostatic latent images formed on the surfaces of the photosensitive drums 40*a* to 40*d* into Y, M, C, and K toner images.

The intermediate-transfer-belt cleaning unit 45 removes a residual toner from the intermediate transfer belt 38 by removing electric charge therefrom.

The intermediate transfer belt 38 is an endless belt supported by a plurality of rollers including the transfer drive roller 31 so that an upper outer circumferential surface on which a toner image is to be transferred is made substantially flat in a horizontal direction. The photosensitive drums 40*a* to 40*d* are aligned on the upper outer circumferential surface of the intermediate transfer belt 38 along a moving direction of the upper outer circumferential surface. Incidentally, as the intermediate transfer belt 38, any of a single-layered resin belt, a two-layered resin belt composed of a coating layer and a core layer (see, for example, Japanese Patent Application Laid-open No. H10-198182), a three-layered resin belt composed of a coating layer, an elastic layer, and a core layer (see, for example, Japanese Patent Application Laid-open No. 2001-312159), and the like can be used for any purpose.

The fixing unit 33 is arranged above the intermediate transfer belt 38. The fixing unit 33 applies heat and pressure to a sheet after a toner image is secondary-transferred onto the sheet. By the application of heat and pressure, the toner image is fixed on the sheet. The fixing unit 33 is unitized for easy maintenance. The fixing unit 33 includes a fixing roller 34 and a pressure roller 35. The fixing roller 34 contains therein a fixing heater to generate heat to be applied to the sheet. The pressure roller 35 is arranged to be opposed to the fixing roller 34, and presses the sheet against the fixing roller 34. As the fixing roller 34, any of a roller that a cylindrical core bar is coated with heat-resistant resin layer and a roller that a cylindrical core bar coated with a heat resistant elastic layer is further coated with a heat-resistant resin layer can be used.

The discharging unit 80 includes discharge rollers 1, 2, and 3, and a branch guide 6. The discharging unit 80 discharges a sheet on which an image has been fixed onto the sheet receiving tray 7. When an image is to be formed on both sides of a sheet, the discharging unit 80 performs switchback-conveys the sheet.

The feed roller 28 is arranged below the intermediate transfer belt 38. The feed roller 28 picks up a sheet from the sheet cassette 27, and feeds the sheet to the registration rollers 29 and 30. The registration rollers 29 and 30 are used for positioning of the sheet fed by the feed roller 28 so that a toner image can be transferred onto the sheet properly. The conveying rollers 36 and 37 convey a switchback-conveyed sheet to the registration rollers 29 and 30. Namely, when an image is to be formed on both sides of a sheet, after the image is formed on one side of the sheet, the sheet is switchback-conveyed to the conveying rollers 36 and 37 by the discharging unit 80, and further conveyed to the registration rollers 29 and 30 by the conveying rollers 36 and 37.

Figure 2:
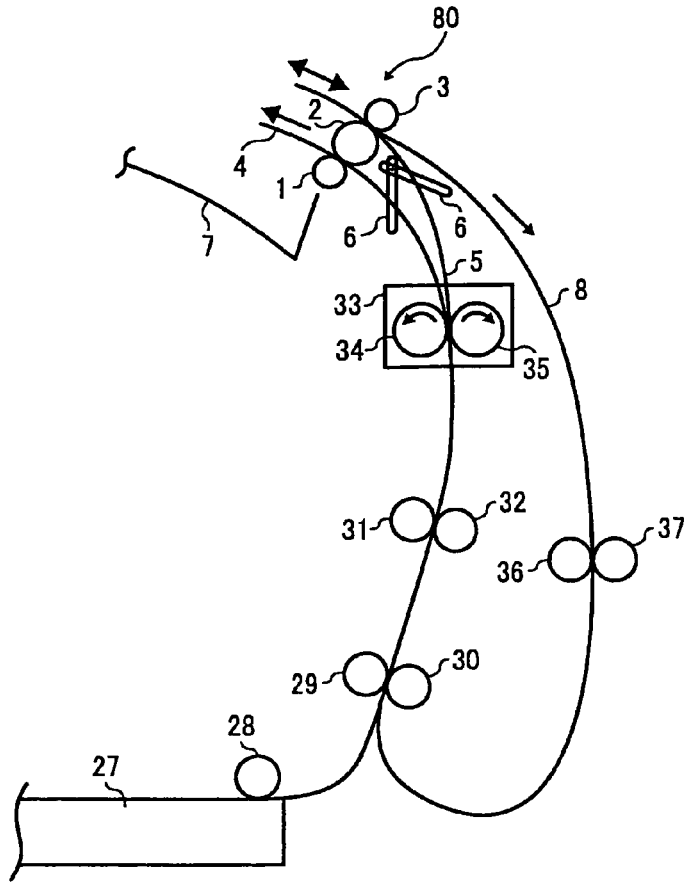
FIG. 2 is a schematic diagram for explaining conveying paths of the color printer shown in FIG. 1.

FIG. 2 is a schematic diagram for explaining conveying paths of the color printer 100. The discharging unit 80 includes the discharge rollers 1, 2, and 3, a plurality of rollers and gears (see FIG. 3), and the branch guide 6. The branch guide 6 is arranged on the upstream side of the discharge roller 2, and guides a sheet to any of a discharge conveying path 4, a switchback conveying path 5, and a duplex-printing conveying path 8 selectively. Three shafts (not shown) of the discharge rollers 1, 2, and 3 are arranged substantially parallel to one another and substantially perpendicular to a conveying direction of the sheet.

The discharge conveying path 4 connects between the fixing unit 33 and a nip portion formed between the discharge rollers 1 and 2. The switchback conveying path 5 connects between the fixing unit 33 and a nip portion formed between the discharge rollers 2 and 3. The duplex-printing conveying path 8 connects between the nip portion formed between the discharge rollers 2 and 3 and the registration rollers 29 and 30 through the conveying rollers 36 and 37.

For example, when an image is to be formed on only one side of a sheet, after a toner image is fixed on the sheet by the fixing unit 33, the branch guide 6 guides the sheet to the discharge conveying path 4. On the other hand, when an image is to be formed on both sides of a sheet, after a toner image is fixed on one side of the sheet by the fixing unit 33, the branch guide 6 guides the sheet to the switchback conveying path 5. When a trailing end of the sheet is held at the nip portion formed between the discharge rollers 2 and 3, the sheet is guided to the duplex-printing conveying path 8.

Figure 3:
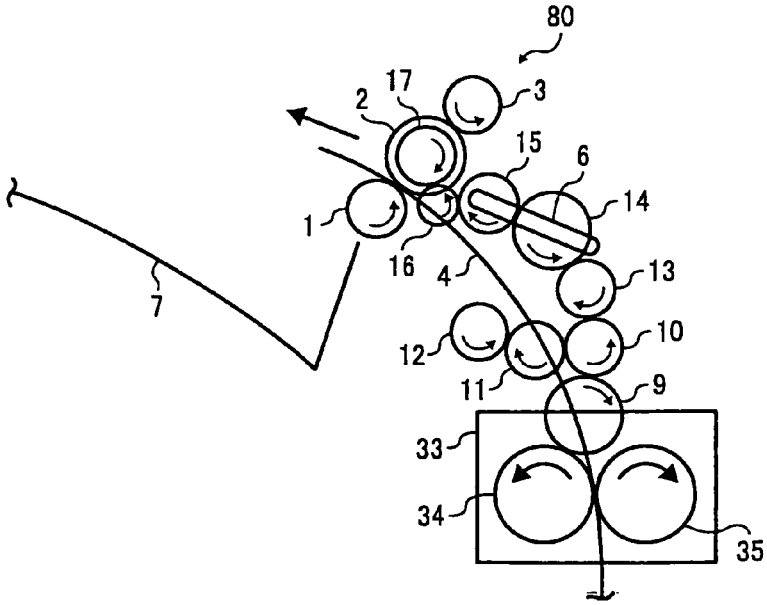
FIG. 3 is a schematic diagram for explaining a discharge behavior of a discharging unit shown in FIG. 2 when an image is to be formed on only one side of a sheet.

FIG. 3 is a schematic diagram for explaining a discharge behavior of the discharging unit 80 when an image is to be formed on only one side of a sheet.

As shown in FIG. 3, the discharging unit 80 further includes a fixed gear 9, four transmission gears 10 to 13, a swing gear 14, and three transmission gears 15 to 17. The fixed gear 9 rotates in one direction (in a clockwise direction in FIG. 3) by engaging with a transmission gear (not shown) provided on the same shaft as the fixing roller 34. The transmission gear 10 rotates in a counterclockwise direction by engaging with the fixed gear 9. The transmission gear 11 rotates in the clockwise direction by engaging with the transmission gear 10. The transmission gear 12 rotates in the counterclockwise direction by engaging with the transmission gear 11. The transmission gear 13 rotates in the clockwise direction by engaging with the transmission gear 10.

Figure 6A:
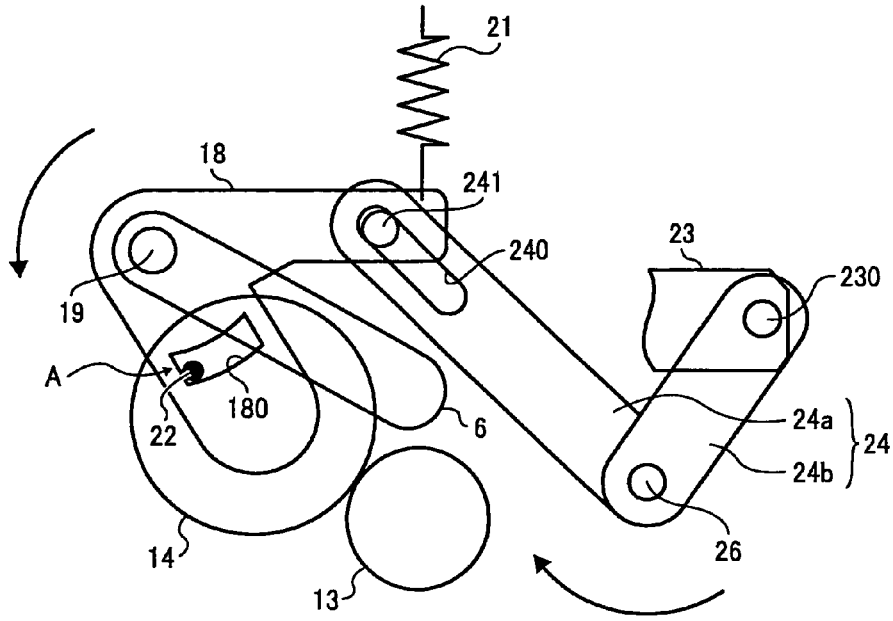
FIGS. 6A and 6B are schematic diagrams for explaining behaviors of a link mechanism and a solenoid mechanism.
Figure 6B:
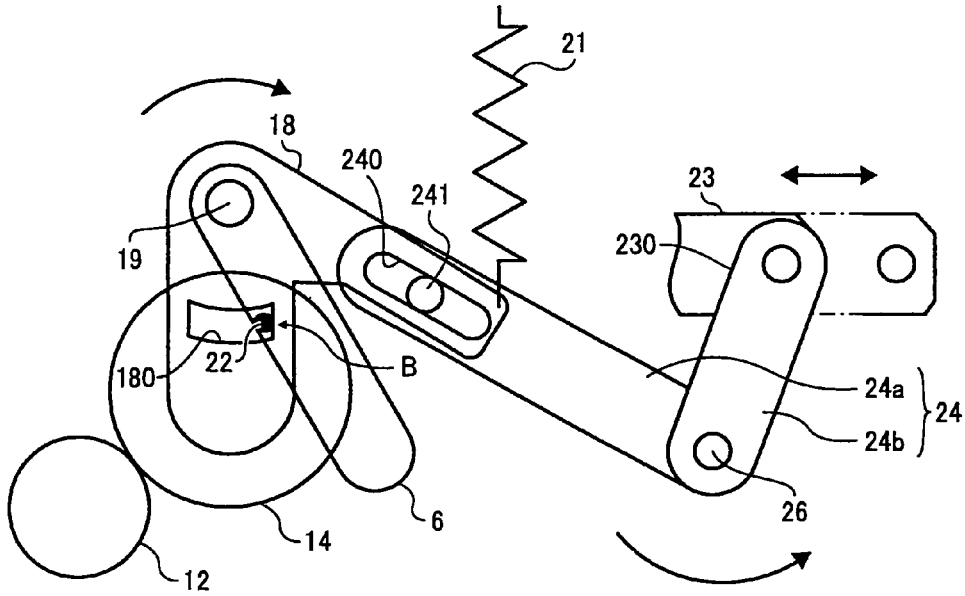

The swing gear 14 swings around a rotating shaft 19 (see FIGS. 6A and 6B). The swing gear 14 rotates in the clockwise direction when the swing gear 14 engages with the transmission gear 12 (see FIG. 4), and rotates in the counterclockwise direction when the swing gear 14 engages with the transmission gear 13 (see FIG. 3). The transmission gear 15 rotates in the clockwise direction (see FIG. 3) or the counterclockwise direction (see FIG. 4) by engaging with the swing gear 14. The transmission gear 16 rotates in the clockwise direction (see FIG. 4) or the counterclockwise direction (see FIG. 3) by engaging with the transmission gear 15. The transmission gear 17 is provided on the same shaft as the discharge roller 2, and rotates in the clockwise direction (see FIG. 3) or the counterclockwise direction (see FIG. 4) by engaging with the transmission gear 16. The branch guide 6 is swingably attached to the rotating shaft 19.

The swing gear 14 can engage with either the transmission gear 12 or the transmission gear 13 by the actions of a link mechanism and a solenoid mechanism (see FIG. 6).

Figure 4:
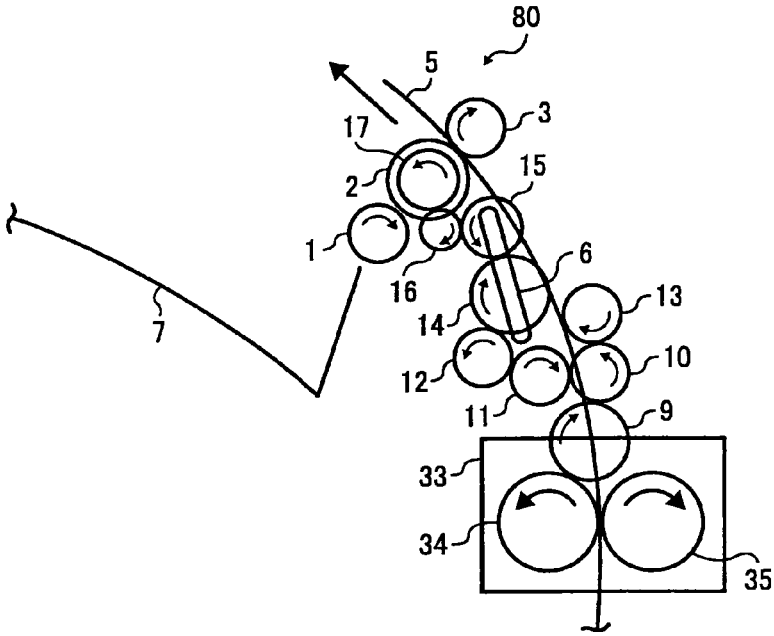
FIG. 4 is a schematic diagram for explaining a switchback conveyance behavior of the discharging unit when an image is to be formed on both sides of a sheet.

When the swing gear 14 engages with the transmission gear 12 (see FIG. 4), a rotation of the fixed gear 9 is transmitted to the swing gear 14 via the odd numbers of transmission gears (corresponding to the transmission gears 10, 11, and 12 in FIG. 4). As a result, the swing gear 14 rotates in the clockwise direction.

On the other hand, when the swing gear 14 engages with the transmission gear 13 (see FIG. 3), the rotation of the fixed gear 9 is transmitted to the swing gear 14 via the even numbers of transmission gears (corresponding to the transmission gears 10 and 13 in FIG. 3). As a result, the swing gear 14 rotates in the counterclockwise direction.

The branch guide 6 swings by the actions of the link mechanism and the solenoid mechanism. Swinging of the branch guide 6 results in switching of conveying paths of the sheet between the discharge conveying path 4, the switchback conveying path 5, and the duplex-printing conveying path 8.

When an image is to be formed on only one side of a sheet, after the image is fixed on the sheet by the fixing unit 33, the swing gear 14 and the transmission gear 13 are engaged with each other by the action of the link mechanism. As a result, the swing gear 14 rotates in the counterclockwise direction, and the branch guide 6 guides the sheet to the discharge conveying path 4. When the swing gear 14 and the transmission gear 13 are engaged with each other, the rotation of the fixed gear 9 is transmitted to the transmission gear 17 via the odd numbers of transmission gears (corresponding to the gears 10, 13, 14, 15, and 16 in FIG. 3). As a result, the transmission gear 17 and the discharge roller 2 rotate in the clockwise direction, and the sheet conveyed on the discharge conveying path 4 is discharged onto the sheet receiving tray 7 through the nip portion formed between the discharge rollers 1 and 2.

Figure 5:
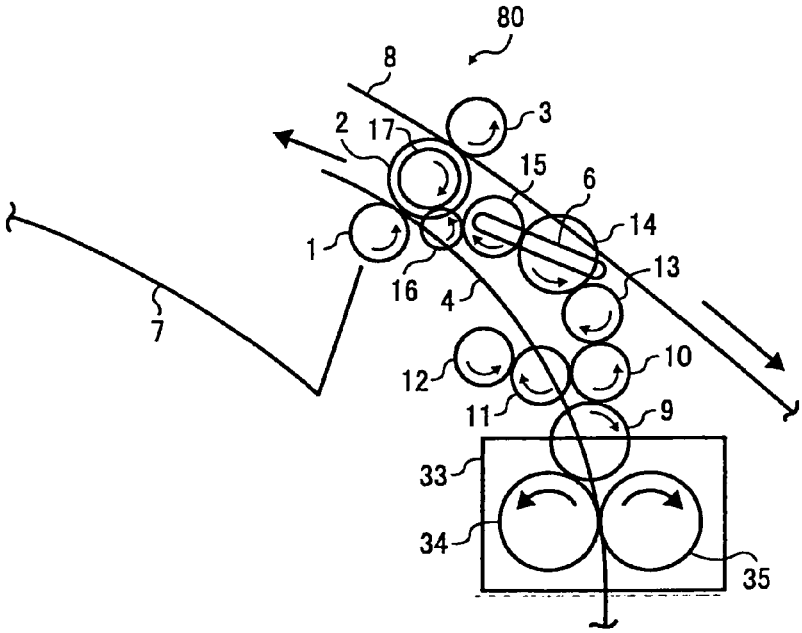
FIG. 5 is a schematic diagram for explaining a reverse conveyance behavior of the discharging unit when the image is to be formed on the both sides of the sheet.

FIG. 4 is a schematic diagram for explaining a switchback conveyance behavior of the discharging unit 80 when an image is to be formed on both sides of a sheet. FIG. 5 is a schematic diagram for explaining a reverse conveyance behavior of the discharging unit 80 when the image is to be formed on the both sides of the sheet. The switchback conveyance and the reverse conveyance are continuously performed to form an image on a reverse side of a sheet.

When an image is to be formed on both sides of a sheet, after a toner image is fixed on one side (the first side) of the sheet by the fixing unit 33, as shown in FIG. 4, the swing gear 14 and the transmission gear 12 are engaged with each other by the actions of the link mechanism and the solenoid mechanism (corresponding to a deformation of the link mechanism by driving of the solenoid mechanism). As a result, the swing gear 14 rotates in the clockwise direction, and the sheet is guided to the switchback conveying path 5 by the branch guide 6. In addition, when the swing gear 14 and the transmission gear 12 are engaged with each other, the rotation of the fixed gear 9 is transmitted to the transmission gear 17 via the even numbers of transmission gears (corresponding to the gears 10, 11, 12, 14, 15, and 16 in FIG. 4). As a result, the transmission gear 17 and the discharge roller 2 rotate in the counterclockwise direction. By the counterclockwise rotation of the discharge roller 2, the conveyance of the sheet guided to the switchback conveying path 5 is temporarily stopped in a state where a trailing end of the sheet is held at the nip portion formed between the discharge rollers 2 and 3.

After that, as shown in FIG. 5, the swing gear 14 and the transmission gear 13 are engaged with each other by the action of the link mechanism (corresponding to a restoration of the link mechanism because the driving of the solenoid mechanism is released). As a result, the swing gear 14 rotates in the counterclockwise direction. In addition, when the swing gear 14 and the transmission gear 13 are engaged with each other, the rotation of the fixed gear 9 is transmitted to the transmission gear 17 via the odd numbers of transmission gears (corresponding to the gears 10, 13, 14, 15, and 16 in FIG. 5), so that the transmission gear 17 and the discharge roller 2 rotate in the clockwise direction. As a result, the discharge roller 1 located on the lower side of the discharge roller 2 in contact with the discharge roller 2 rotates in the counterclockwise direction, and the discharge roller 3 located on the upper side of the discharge roller 2 in contact with the discharge roller 2 rotates in the counterclockwise direction. The branch guide 6 guides the sheet which trailing end is held at the nip portion formed between the discharge rollers 2 and 3 to the duplex-printing conveying path 8. After that, the branch guide 6 changes a guiding direction so as to guide the sheet to the discharge conveying path 4 after the image is formed on both sides of the sheet.

In this manner, when an image is to be formed on both sides of a sheet, after the image is formed on the first side of the sheet, the sheet is conveyed to the switchback conveying path 5 until a trailing end of the sheet is held at the nip portion formed between the discharge rollers 2 and 3, and guided to the duplex-printing conveying path 8 by the clockwise rotation of the discharge roller 2. After that, the sheet is reversed, and again conveyed to the registration rollers 29 and 30. Then, the sheet is conveyed to the transfer drive roller 31 and the transfer driven roller 32, and an image is formed on the other side (the second side) of the sheet. After a toner image formed on the second side of the sheet is fixed by the fixing unit 33, the sheet is guided to the discharge conveying path 4, and then discharged onto the sheet receiving tray 7.

FIGS. 6A and 6B are schematic diagrams for explaining configurations and behaviors of the link mechanism and the solenoid mechanism. FIG. 6A illustrates a bent state of the link mechanism and the solenoid mechanism when the swing gear 14 engages with the transmission gear 13. FIG. 6B illustrates a non-bent state of the link mechanism and the solenoid mechanism when the swing gear 14 engages with the transmission gear 12.

As shown in FIGS. 6A and 6B, the discharging unit 80 includes a link mechanism, a spring 21, a solenoid mechanism 23, and the branch guide 6. The link mechanism includes a substantially V-shaped switching link 18 and a substantially L-shaped transmission link 24. The L-shaped transmission link 24 is composed of a long link 24*a* and a short link 24*b*. The spring 21 expands and contracts in a vertical direction in FIGS. 6B and 6A. One end of the spring 21 is attached to the link mechanism, and the other end of the spring 21 is attached to a hook member (not shown) of a supporting member. One end of the solenoid mechanism 23 is attached to a second end of the short link 24*b* so that the solenoid mechanism 23 causes the second end of the short link 24*b* to move to the left or right in FIGS. 6A and 6B. The branch guide 6 switches a conveying path of a sheet in accordance with a rotation of the link mechanism.

A projection 241 is formed on the side of a first end of the switching link 18 where the end of the spring 21 is attached. A long hole 240 is formed on a first end of the long link 24*a*. The projection 241 is movably engaged with the long hole 240 so that the projection 241 can move within the long hole 240. In accordance with the movement of the projection 241, the switching link 18 and the transmission link 24 are in the bent state (see FIG. 6A) or the non-bent state (see FIG. 6B).

A bent portion of the V-shaped switching link 18 is rotatably secured to the rotating shaft 19. The rotating shaft 19 is rotatably supported by the supporting member. One end of the branch guide 6 is fixed to the rotating shaft 19 so as to prevent a phase shifting between the branch guide 6 and the switching link 18 from occurring. The branch guide 6 rotates around the rotating shaft 19 in accordance with a rotation of the switching link 18, and thereby switching the conveying path to any of the discharge conveying path 4, the duplex-printing conveying path 8, and the switchback conveying path 5.

The transmission gear 15 (not shown in FIGS. 6A and 6B) is attached to the rotating shaft 19. The transmission gear 15 engages with the swing gear 14 attached to a second end of the switching link 18, and rotates. In accordance with the rotation of the branch guide 6, a drive-force transmission path from the fixed gear 9 to the swing gear 14 is switched, and a rotating direction of the swing gear 14 is also switched. As a result, a rotating direction of the discharge roller 2 is switched to either the clockwise direction or the counterclockwise direction.

A through groove 180 for limiting a rotating area of the switching link 18 is formed on the side of the second end of the switching link 18. A projection 22 formed on the supporting member is engaged with the through groove 180. The switching link 18 can rotate between a first position where the projection 22 is bumped into an end wall A of the through groove 180 (see FIG. 6A) and a second position where the projection 22 is bumped into an end wall B of the through groove 180 (see FIG. 6B). Incidentally, the swing gear 14 also rotates within the rotating area of the switching link 18 because the swing gear 14 is rotatably attached to the side of the second end of the switching link 18.

A bent portion of the L-shaped transmission link 24 (corresponding to a second end of the long link 24*a* and a first end of the short link 24*b*) is rotatably secured to a rotating shaft 26. The rotating shaft 26 is rotatably supported by the supporting member. The solenoid mechanism 23 is attached to the second end of the short link 24*b*. Specifically, a projection 230 formed on the end of the solenoid mechanism 23 is engaged with an engaging hole formed on the second end of the short link 24*b*.

When the solenoid mechanism 23 is not in driving, as shown in FIG. 6A, the first end side of the switching link 18 is biased in an upward direction by the action of a spring force produced by elasticity of the spring 21. As a result, the projection 22 is bumped into the end wall A of the through groove 180. At this time, the switching link 18 and the long link 24*a* are in the bent state. In the bent state, the swing gear 14 attached to the second end of the switching link 18 engages with the transmission gear 13, and the branch guide 6 guides a sheet to any of the discharge conveying path 4 and the duplex-printing conveying path 8.

In the bent state, when the solenoid mechanism 23 starts driving, the switching link 18 rotates around the rotating shaft 19 in the clockwise direction, and the transmission link 24 rotates around the rotating shaft 26 in the counterclockwise direction. When the switching link 18 and the long link 24*a* are in the non-bent state as shown in FIG. 6B, the switching link 18 and the transmission link 24 stop rotating. In the non-bent state, the swing gear 14 attached to the second end of the switching link 18 engages with the transmission gear 12, and the branch guide 6 guides a sheet to the switchback conveying path 5.

Specifically, by driving of the solenoid mechanism 23, as shown in FIG. 6B, the second end of the short link 24*b* is pulled to the left. As a result, the transmission link 24 rotates around the rotating shaft 26 in the counterclockwise direction. In accordance with the counterclockwise rotation of the transmission link 24, the first end of the long link 24*a* rotates in the counterclockwise direction, the switching link 18 engaged with the first end of the long link 24*a* rotates around the rotating shaft 19 in the clockwise direction, and the spring 21 attached to the first end of the switching link 18 expands, in a downward direction by the action of the elasticity of the spring 21 (see FIG. 6B). At this time, the spring force of the spring 21 biasing in the upward direction becomes larger than that is in the bent state. However, a pulling force produced by the driving of the solenoid mechanism 23 is against the spring force in the upward direction in the non-bent state, so that the second end of the short link 24*b* is not pulled back to the right in FIG. 6B.

On the side of the second end of the switching link 18, the projection 22 formed on the supporting member moves toward the end wall B of the through groove 180 in accordance with the clockwise rotation of the switching link 18. When the projection 22 is bumped into the end wall B of the through groove 180, the clockwise rotation of the switching link 18 is stopped. In addition, in accordance with the clockwise rotation of the switching link 18, the projection 241 formed on the side of the first end of the switching link 18 moves in the long hole 240 formed on the long link 24*a*, and stops moving when the projection 22 is bumped into the end wall B (i.e., when it becomes in the non-bent state).

In the non-bent state, when the driving of the solenoid mechanism 23 is released by a command from a control unit (for example, a microcomputer) of the color printer 100, the switching link 18 rotates around the rotating shaft 19 in the counterclockwise direction, and the transmission link 24 rotates around the rotating shaft 26 in the clockwise direction. The side of the first end of the long link 24*a* is restored by the action of the elasticity of the spring 21 to be back in the bent state as shown in FIG. 6A. In the present embodiment, the switching link 18 and the transmission link 24 are in the bent state and the non-bent state alternately so as to form an image on both sides of a sheet.

Subsequently, a printing process performed by the color printer 100 is explained in detail below.

A sheet set in the sheet cassette 27 is fed to the registration rollers 29 and 30 by the feed roller 28, and then conveyed to the transfer drive roller 31 and the transfer driven roller 32. The transfer drive roller 31 is located inside a loop of the intermediate transfer belt 38, and causes the intermediate transfer belt 38 to rotate by a rotation of the transfer drive roller 31.

In an image forming process performed by the process units 42*a* to 42*d*, the charging rollers 41*a* to 41*d* uniformly charge surfaces of the photosensitive drums 40*a* to 40*d* by having contact with the surfaces of the photosensitive drums 40*a* to 40*d*, respectively. The exposure unit 43 exposes each of the surfaces of the photosensitive drums 40*a* to 40*d* to the laser light 44, and thereby forming an electrostatic latent image on each of the surfaces of the photosensitive drums 40*a* to 40*d*. The developing units 39*a* to 39*d* respectively develop the electrostatic latent image formed on each of the surfaces of the photosensitive drums 40*a* to 40*d* into a toner image. The toner images formed on the surfaces of the photosensitive drums 40*a* to 40*d* are sequentially transferred onto the surface of the intermediate transfer belt 38 in a superimposed manner.

The superimposed toner image on the surface of the intermediate transfer belt 38 is transferred onto a sheet by the transfer drive roller 31 and the transfer driven roller 32. The sheet is conveyed to the fixing unit 33, and the superimposed toner image is fixed on the sheet by the fixing roller 34 and the pressure roller 35. Then, the printing process is terminated.

When an image is to be formed on both sides of a sheet, as described above, the switching link 18 and the transmission link 24 are in the non-bent state and the bent state alternately. When the switching link 18 and the transmission link 24 are in the bent state, if the solenoid mechanism 23 starts driving, the switching link 18 and the transmission link 24 become in the non-bent state. By the driving of the solenoid mechanism 23, the transmission link 24 rotates around the rotating shaft 26 in the counterclockwise direction, the switching link 18 rotates around the rotating shaft 19 in the clockwise direction, and the spring 21 is pulled to the downward direction to expand. When the projection 22 formed on the supporting member is bumped into the end wall B of the through groove 180 formed on the side of the second end of the switching link 18, the rotations of the switching link 18 and the transmission link 24 are stopped. At this time, the switching link 18 and the transmission link 24 are in the non-bent state (see FIG. 6B).

In the non-bent state, the swing gear 14 attached to the second end of the switching link 18 engages with the transmission gear 12. Therefore, the clockwise rotation of the fixed gear 9 is transmitted to the transmission gear 17 via the transmission gear 10, the transmission gear 11, the transmission gear 12, the swing gear 14, the transmission gear 15, and the transmission gear 16. The discharge roller 2 attached to the same shaft as the transmission gear 17 rotates in the counterclockwise direction. The branch guide 6 attached to the same shaft as the switching link 18 guides a sheet, which an image has been formed on its first side, to the switchback conveying path 5. The sheet guided to the switchback conveying path 5 by the branch guide 6 is conveyed toward the sheet receiving tray 7 with being held between the discharge rollers 2 and 3 until a trailing end of the sheet is held at the nip portion formed between the discharge rollers 2 and 3.

Subsequently, when it becomes in the non-bent state, the driving of the solenoid mechanism 23 is released. Then, the transmission link 24 rotates around the rotating shaft 26 in the clockwise direction, the switching link 18 rotates around the rotating shaft 19 in the counterclockwise direction, and the side of the first end of the switching link 18 is biased in the upward direction by the action of the elasticity of the spring 21. The projection 22 formed on the supporting member is bumped into the end wall A of the through groove 180 formed on the side of the second end of the switching link 18. At this time, the side of the first end of the switching link 18 is bent with respect to the long link 24*a* (see FIG. 6A). The swing gear 14 attached to the second end of the switching link 18 engages with the transmission gear 13. Therefore, the clockwise rotation of the fixed gear 9 is transmitted to the transmission gear 17 via the transmission gear 10, the transmission gear 13, the swing gear 14, the transmission gear 15, and the transmission gear 16. The discharge roller 2 attached to the same shaft as the transmission gear 17 rotates in the clockwise direction. The discharge rollers 1 and 3 rotate in the counterclockwise direction.

The branch guide 6 attached to the same shaft as the switching link 18 guides the sheet which trailing end is held at the nip portion formed between the discharge rollers 2 and 3 to the duplex-printing conveying path 8. After that, the branch guide 6 changes a guiding direction so as to guide the sheet to the discharge conveying path 4 after the image is formed on both sides of the sheet. Namely, the sheet that the image has been formed on its first side is switched back, and conveyed to the duplex-printing conveying path 8 so that an image is formed on the second side of the sheet. The sheet conveyed to the duplex-printing conveying path 8 is conveyed to the registration rollers 29 and 30 through the conveying rollers 36 and 37. After the image has been formed on the second side of the sheet, the sheet is conveyed to the discharge conveying path 4, and discharged onto the sheet receiving tray 7 through the discharge rollers 1 and 2.

In this manner, in the color printer 100 in which a drive force of the fixed gear 9 that rotates not in both the forward direction and the reverse direction but in either one direction only is transmitted to the discharge rollers 1 to 3, the swing gear 14 is attached to the branch guide 6 via the switching link 18 and the transmission link 24 as the link mechanism. With the configuration, it is possible to perform a switching among the discharge conveying path 4, the duplex-printing conveying path 8, and the switchback conveying path 5 by the branch guide 6 and a switching of a rotating direction of the transmission gear 17 simultaneously. Therefore, it is not necessary to include a drive source capable of driving the discharge rollers to rotate in any of the forward direction and the reverse direction. Consequently, the configuration of the color printer 100 can be simplified.

Furthermore, in the color printer 100, the branch guide 6 is coupled to the swing gear 14 via the switching link 18. Therefore, with only one positioning boss (corresponding to the projection 22), the gears can be positioned with respect to any of two conveying paths (corresponding to either the discharge conveying path 4 or the duplex-printing conveying path 8 and the switchback conveying path 5) and any of two drive-force transmission paths (corresponding to a drive-force transmission path connecting from the fixed gear 9 to the swing gear 14 via the transmission gears 10 and 13 and a drive-force transmission path connecting from the fixed gear 9 to the swing gear 14 via the transmission gears 10, 11, and 12). Thus, the number of positioning members requiring a positional accuracy (corresponding to the swing gear 14, the link mechanism, i.e., the switching link 18 and the transmission link 24, and the branch guide 6) can be minimized. In addition, the number of the gears composing the drive-force transmission paths can be reduced. Moreover, with the link mechanism, a drive force (a pulling force) of the solenoid can act effectively by the use of a ratio of arms of the link mechanism. Consequently, it is possible to employ a cheap solenoid, even though the solenoid can produce a low drive force.

Furthermore, in the color printer 100, the switching link 18 and the transmission link 24 are bendably engaged with each other, and the solenoid mechanism 23 is arranged on the inner side of the transmission link 24 (the left side in FIGS. 6A and 6B). Therefore, an installation space for the positioning members and drive members (corresponding to the spring 21 and the solenoid mechanism 23) can be reduced as compared with, for example, a configuration in which a solenoid mechanism is arranged on the outer side of a guiding member (corresponding to the branch guide 6) (the right side in FIGS. 6A and 6B) so that a rotating/reciprocating movement can be obtained by the actions of the solenoid mechanism and a spring (see Japanese Patent Application Laid-open No. 2007-76881). Consequently, it is possible to allow a greater degree of design freedom.

Moreover, in the color printer 100, one end of the solenoid mechanism 23 is engaged with the second end of the short link 24*b* of the L-shaped transmission link 24. Therefore, a drive force produced by a linear movement of the solenoid mechanism 23 can be converted into a rotation of the transmission link 24 around the rotating shaft 26, and the rotation can be transmitted to the switching link 18. Thus, by the drive force of the solenoid mechanism 23 located away from the discharge roller 2 of the discharging unit 80, the branch guide 6 and the swing gear 14 can be driven to rotate at the same time. Furthermore, it is possible to ensure a greater degree of design freedom in a layout of the solenoid mechanism 23. Thus, it is possible to use a space in an enclosure of the color printer 100 effectively.

In the embodiment, the three discharge rollers 1, 2, and 3 of the discharging unit 80 are used for the switchback conveyance, the discharge conveyance, and the duplex-printing conveyance. However, the present invention is not limited to the embodiment. The present invention can be applied to, for example, three conveying rollers as long as the conveying rollers can be used for the switchback conveyance.

According to an aspect of the present invention, a switchback mechanism includes a first roller group, a second roller group, a switching guide, a drive gear, a first transmission-gear group, a second transmission-gear group, a switching gear, a first link, and a second link. The first roller group is composed of a first roller, a second roller, and a third roller, and the second roller is in contact with the first roller and the third roller. The second roller group is composed of a fourth roller and a fifth roller, and the fourth roller and the fifth roller being in contact with each other. The switching guide rotates around a rotating shaft supported by a supporting member, and switches a conveying path of a sheet between a switchback conveying path and a non-switchback conveying path. The switchback conveying path connects between a first nip portion formed between the fourth roller and the fifth roller and a second nip portion formed between the second roller and the third roller. The non-switchback conveying path connects between the second nip portion and a third nip portion formed between the first roller and the second roller via the first nip portion. The drive gear is coupled to the fourth roller, and rotates in a first direction by receiving a drive force from the fourth roller. The first transmission-gear group is composed of the even numbers of transmission gears, and transmits a drive force from the drive gear as a rotation in the first direction. The second transmission-gear group is composed of the odd numbers of transmission gears, and transmits the drive force from the drive gear as a rotation in a second direction opposite to the first direction. The switching gear is connected to any of the first transmission-gear group and the second transmission-gear group, and transmits the drive force from the drive gear to the second roller as any of the rotation in the first direction and the rotation in the second direction via a third transmission-gear group composed of even numbers of transmission gears. The switching gear is attached to one end of the first link, and the first link rotates around the rotating shaft to switch a connection of the switching gear to any of the first transmission-gear group and the second transmission-gear group. The second link that is connected to the other end of the first link to interlock the connection of the switching gear to any of the first transmission-gear group and the second transmission-gear group with a conveyance of the sheet to any of the switchback conveying path and the non-switchback conveying path switched by the switching guide. With the configuration, a switching of the conveying path by the switching guide (corresponding to the branch guide) and a switching of the transmission-gear group (corresponding to a switching of a rotating direction of the drive gear when a drive force is transmitted) by the first link can be simultaneously performed by a movement of the second link. Therefore, the switchback mechanism can perform switchback conveyance of a sheet for duplex printing without a drive source capable of driving discharge rollers to rotate in any of a forward direction and a reverse direction.

Furthermore, according to another aspect of the present invention, for example, when the switching gear is connected to the second transmission-gear group, the second roller rotates in the other direction (for example, in a direction opposite to the rotation of the drive gear), and the switching guide switches the conveyance of the sheet to the switchback conveying path. When the switching gear is connected to the first transmission-gear group, the second roller rotates in one direction (for example, in the rotating direction of the drive gear), and the switching guide switches the conveyance of the sheet to the non-switchback conveying path.

Moreover, according to still another aspect of the present invention, the first link rotates in conjunction with the second link. When a projection formed on the supporting member is bumped into any one of end walls of a through groove formed on the first link, a switching of the transmission-gear group by the first link and a switching of the conveying path by the switching guide are performed. Therefore, when a switching of the switching guide requiring a positional accuracy (corresponding to the branch guide) and a switching of the connection of the switching gear to the transmission-gear group are simultaneously performed, those members can be positioned by bumping the projection into any of the end walls of the through groove. Thus, it is possible to reduce the number of positioning members and a cost.

Furthermore, according to still another aspect of the present invention, the switchback mechanism further includes a solenoid mechanism that transmits a drive force produced by its linear movement to the second link. The second link has a substantially L-shape, and rotates around a bent portion of the L-shaped second link by receiving the drive force from the solenoid mechanism. The first link rotates around the rotating shaft in accordance with the rotation of the second link. Therefore, even though the solenoid mechanism is arranged away from the first roller group and the switching guide (corresponding to the branch guide) used for the switchback conveyance, the drive force produced by the linear movement of the solenoid mechanism can be converted into a rotation of the second link, and the rotation can be transmitted to the first link. Consequently, it is possible to allow a greater degree of design freedom in a layout of the solenoid mechanism as a drive member.

Moreover, according to still another aspect of the present invention, the switchback mechanism is used as a discharging unit of an image forming apparatus. Therefore, in the discharging unit, a switching of the conveying path by the switching guide (corresponding to the branch guide) with the use of the movement of the second link and a switching of a rotating direction of the second roller by the first link can be simultaneously performed. Consequently, the configuration of the image forming apparatus can be simplified, and also a design freedom of the image forming apparatus can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying apparatus, comprising:

a downstream roller group having a downstream drive roller, a first driven roller, and a second driven roller, the downstream drive roller being in contact with the first driven roller and the second driven roller;

an upstream roller group having a upstream drive roller and a upstream driven roller, the upstream drive roller and the upstream driven roller being in contact with each other;

a first conveying path configured to connect between a nip between the upstream drive roller and the upstream driven roller and a nip between the downstream drive roller and the first driven roller, a second conveying path configured to connect between the nip between the upstream drive roller and the upstream driven roller and a nip between the downstream drive roller and the second driven roller;

a switching guide configured to switch a conveying path of a sheet between the first conveying path and the second conveying path;

a drive gear configured to drive the upstream drive roller in a direction in which the upstream roller group convey the sheet toward the downstream roller group;

a first transmission-mechanism configured to transmit a drive force from the drive gear to the downstream drive roller as a rotation in a first direction;

a second transmission-mechanism configured to transmit the drive force from the drive gear to the downstream drive roller as a rotation in a second direction opposite to the first direction;

a switching gear configured to selectively connect in the first transmission-mechanism and in the second-transmission mechanism; and a link mechanism configured to couple the switching gear and the switching guide, wherein the switching guide switches the first conveying path when the switching gear connects in the first transmission-mechanism, and the switching guide switches the second conveying path when the switching gear connects in the second transmission-mechanism.

2. The sheet conveying apparatus according to claim 1, wherein when an image is to be formed on only one side of a sheet, the switching gear and the second transmission-mechanism engage with each other by an action of the link mechanism.

3. The sheet conveying apparatus according to claim 2, wherein the second transmission-mechanism is composed of odd numbers of transmission gears.

4. The sheet conveying apparatus according to claim 1, wherein when an image is to be formed on two side of a sheet, the switching gear and the first transmission-mechanism engage with each other by an action of the link mechanism.

5. The sheet conveying apparatus according to claim 4, wherein the first transmission-mechanism is composed of even numbers of transmission gears.

6. The sheet conveying apparatus according to claim 1, wherein the link mechanism further includes:

a first link that the switching gear is attached to one end thereof, and rotates around the rotating shaft to switch a connection of the switching gear to one of the first transmission-mechanism and the second transmission-mechanism; and a second link that is connected to the other end of the first link to interlock the connection of the switching gear to one of the first transmission-mechanism and the second transmission-mechanism with a conveyance of the sheet to one of the first conveying path and the second conveying path switched by the switching guide.

7. The sheet conveying apparatus according to claim 6, wherein a through groove extending in a rotating direction of the first link is formed on the first link, a projection to be engaged with the through groove is formed on a supporting member, and when the projection is bumped into any one of end walls of the through groove, the connection of the switching gear to one of the first transmission-mechanism and the second transmission-mechanism and the conveyance of the sheet to one of the first conveying path and the second conveying path switched by the switching guide are switched.

8. The sheet conveying apparatus according to claim 6, further comprising a solenoid mechanism that transmits a drive force produced by a linear movement of the solenoid mechanism to the second link, wherein the second link rotates around a bent portion of the second link by receiving the drive force from the solenoid mechanism, and the first link rotates around the rotating shaft in accordance with a rotation of the second link.

9. The sheet conveying apparatus according to claim 6, wherein the first link is substantially V-shaped and the second link is substantially L-shaped.

10. The sheet conveying apparatus according to claim 6, further comprising a spring attached to the link mechanism at one end thereof.

11. The sheet conveying apparatus according to claim 10, further comprising:

a projection formed on a side of the end of the first link where the end of the spring is attached; and a long hole formed on an end of the second link where the first link is connected, wherein the projection is movably engaged with the long hole so that the projection can move within the long hole.

12. A sheet conveying apparatus, comprising:

a downstream roller group having a downstream drive roller and a downstream driven roller, the downstream drive roller and the downstream driven roller being in contact with each other;

an upstream roller group having a upstream drive roller and a upstream driven roller, the upstream drive roller and the upstream driven roller being in contact with each other;

a first conveying path configured to connect between a nip between the upstream roller group and a nip between the downstream roller group;

a return conveying path configured to connect between the nip between downstream roller group and upstream of the upstream roller group bypassing the nip between the upstream roller group;

a switching guide configured to switch a conveying path of a sheet between the first conveying path and the return conveying path;

a drive gear configured to drive the upstream drive roller in a direction in which the upstream roller group convey the sheet toward the downstream roller group;

a first transmission-mechanism configured to transmit a drive force from the drive gear to the downstream drive roller as a rotation in a first direction;

a second transmission-mechanism configured to transmit the drive force from the drive gear to the downstream drive roller as a rotation in a second direction opposite to the first direction;

a switching gear configured to selectively connect in the first transmission-mechanism and in the second transmission-mechanism;

a link mechanism configured to couple the switching gear and the switching guide, wherein the switching guide switches the first conveying path when the switching gear connects in the first transmission-mechanism, and the switching guide switches the return conveying path when the switching gear connects in the second transmission-mechanism.

13. The sheet conveying apparatus according to claim 12, wherein the link mechanism further includes:

a first link that the switching gear is attached to one end thereof, and rotates around the rotating shaft to switch a connection of the switching gear to one of the first transmission-mechanism and the second transmission-mechanism; and a second link that is connected to the other end of the first link to interlock the connection of the switching gear to one of the first transmission-mechanism and the second transmission-mechanism with a conveyance of the sheet to one of the first conveying path and the return conveying path switched by the switching guide.

14. The sheet conveying apparatus according to claim 13, wherein a through groove extending in a rotating direction of the first link is formed on the first link, a projection to be engaged with the through groove is formed on a supporting member, and when the projection is bumped into any one of end walls of the through groove, the connection of the switching gear to one of the first transmission-mechanism and the second transmission-mechanism and the conveyance of the sheet to one of the first conveying path and the return conveying path switched by the switching guide are switched.

15. The sheet conveying apparatus according to claim 13, further comprising a solenoid mechanism that transmits a drive force produced by a linear movement of the solenoid mechanism to the second link, wherein the second link rotates around a bent portion of the second link by receiving the drive force from the solenoid mechanism, and the first link rotates around the rotating shaft in accordance with a rotation of the second link.

16. The sheet conveying apparatus according to claim 13, wherein the first link is substantially V-shaped and the second link is substantially L-shaped.

17. A sheet conveying apparatus, comprising:

a downstream roller group having a downstream drive roller, a first driven roller, and a second driven roller, the downstream drive roller being in contact with the first driven roller and the second driven roller;

an upstream roller group having an upstream drive roller and an upstream driven roller, the upstream drive roller and the upstream driven roller being in contact with each other;

a first conveying path configured to connect between a nip between the upstream drive roller and the upstream driven roller and a nip between the downstream drive roller and the first driven roller;

a second conveying path configured to connect between the nip between the upstream drive roller and the upstream driven roller and a nip between the downstream drive roller and the second driven roller;

a return conveying path configured to connect between the nip between the downstream drive roller and the second driven roller and upstream of the upstream roller group bypassing the nip between the upstream drive roller and the upstream driven roller; and a switching guide configured to switch a conveying path of a sheet between the first conveying path and the second conveying path, wherein the switching guide switches the return conveying path for the sheet conveying from the nip between the downstream drive roller and the second driven roller, as the switching guide switches the first conveying path for the sheet conveying from the nip between the upstream drive roller and the upstream driven roller.

* * * * *